US008365934B2

(12) United States Patent
Hamana et al.

(10) Patent No.: US 8,365,934 B2
(45) Date of Patent: Feb. 5, 2013

(54) SYNTHETIC RESIN CAP

(75) Inventors: Hiroshi Hamana, Hyogo (JP); Atsushi Miyagi, Hyogo (JP)

(73) Assignee: Nihon Yamamura Glass Co., Ltd., Hyogo (JP)

( * ) Notice: Subject to any disclaimer, the term of this patent is extended or adjusted under 35 U.S.C. 154(b) by 188 days.

(21) Appl. No.: 12/746,562

(22) PCT Filed: Sep. 26, 2008

(86) PCT No.: PCT/JP2008/067395

§ 371 (c)(1),
(2), (4) Date: Jun. 7, 2010

(87) PCT Pub. No.: WO2009/084292

PCT Pub. Date: Jul. 9, 2009

(65) Prior Publication Data

US 2010/0276387 A1 Nov. 4, 2010

(30) Foreign Application Priority Data

Dec. 28, 2007 (JP) ..... 2007-339151

(51) Int. Cl.
*B65D 41/34* (2006.01)

(52) U.S. Cl. ..... 215/330; 215/253; 220/266

(58) Field of Classification Search ..... 220/266, 220/265, 260, 288, 200; 215/200, 330, 316, 215/253, 252, 250, 344, 343, 341, 356, 364, 215/355, DIG. 1; *B65D 41/34*

See application file for complete search history.

(56) References Cited

U.S. PATENT DOCUMENTS

| | | | | |
|---|---|---|---|---|
| 3,074,579 | A * | 1/1963 | Miller | 215/344 |
| 5,715,959 | A * | 2/1998 | Pfefferkorn et al. | 215/252 |
| 6,381,928 | B1 * | 5/2002 | Gregory | 53/468 |
| 6,695,161 | B2 | 2/2004 | Kano et al. | |
| 2001/0027957 | A1 | 10/2001 | Kano | |
| 2003/0015490 | A1 * | 1/2003 | Taha | 215/252 |
| 2004/0060893 | A1 | 4/2004 | Kano et al. | |
| 2005/0211659 | A1 * | 9/2005 | Tsutsumi et al. | 215/344 |
| 2006/0138073 | A1 * | 6/2006 | Ooka et al. | 215/344 |
| 2006/0255003 | A1 * | 11/2006 | Fuchs | 215/252 |

FOREIGN PATENT DOCUMENTS

| | | |
|---|---|---|
| FR | 2 900 908 | 11/2007 |
| JP | 6-33098 | 11/1988 |
| JP | 2002-173157 | 6/2002 |
| JP | 2004-331137 | 11/2004 |

* cited by examiner

*Primary Examiner* — Jacob K Ackun
*Assistant Examiner* — Robert J Hicks
(74) *Attorney, Agent, or Firm* — Wenderoth, Lind & Ponack, L.L.P.

(57) ABSTRACT

A synthetic resin cap includes a top wall, a skirt wall, and a tamper evidence band connected to the skirt wall with bridges interposed therebetween. An inner face of the top wall includes an annular inner leg, an annular projection, and an annular outer leg. An intermediate part of the inner leg has a substantially constant transverse thickness in a vertical direction. Inner and outer circumferential faces of the intermediate part have substantially the same curvature of longitudinal section and are arcuate and convex inwardly in a radial direction, and an outer circumferential face of a distal end part of the inner leg has a guide face that guides the container mouth part, and the intermediate part is inclined radially outwardly so that an upper end of the guide face is shifted radially inwardly by 0.1 to 0.6 mm when the inner leg is inserted in the container mouth part.

8 Claims, 4 Drawing Sheets

SYNTHETIC RESIN CAP

TECHNICAL FIELD

The present invention relates to a synthetic resin cap having a one-piece structure that is detachably attached by screwing to a mouth part of a container that stores contents, for example, drinking water, alcohol and the like, and in particular, relates to a pilfer proof cap having a function of proving that the container is not opened (never opened).

BACKGROUND ART

As a synthetic resin cap having a conventional one-piece structure, there is known a plastic cap having a substantially circular top plate and a skirt pending from a circumference of the top plate, which are integrally formed of plastic, the skirt being provided in its inner circumferential face with an engagement portion for fastening such as a thread with respect to a container, wherein in an inner corner part between the top plate and the skirt, an undeformable annular reception seat adapted to closely engage a part spanning from an upper edge to an outer circumference of a container mouth, and at least one projection portion for sealing projecting by a very small distance from a plane of the container mouth passing the plane of the reception seat, and situated on the reception seat with an annular groove interposed therebetween are provided, and when the cap is fastened to the container mouth, the projection portion for sealing is deformed by compression exclusively in a position where the container mouth and the reception seat engage each other, and hermetical sealing is achieved by the pressure accompanying the compression deformation of the projection portion for sealing (See Patent Document 1).

Patent Document 1: Japanese Examined Patent Publication No. 6-33098

SUMMARY OF THE INVENTION

Problems to be Solved by the Invention

However, in the above cap, when a tamper evidence band is connected to a lower part of the skirt via breakable bridges, and the cap is used as a pilfer proof cap, hermetical sealing will be canceled by turning a slight angle for opening, prior to breakage of the bridges, so that a tamper evidence performance (or unopened proving function) may be insufficient.

In addition, not limited to the aforementioned cap, a cap having a conventional one-piece structure is generally difficult to have both sealing performance and opening performance (easiness of opening), and since a hermetically sealing part also rotates as the cap is turned, the contents easily leak before breakage of the bridges, and when fitting of the hermetical sealing part is strengthened so as to inhibit the leakage, a problem of impracticality arises that opening becomes more difficult.

Further, in a cap having a conventional one piece structure, leakage is likely to occur when bridges are partly broken. In other words, before the bridges are entirely broken as a result of the opening operation, a state where the bridges are partly broken, or extend, while the remaining bridges are in their initial states is experienced, and the cap in this state has a problem that it is likely to be inclined, and leakage is likely to occur as the cap is inclined.

The present invention has been devised in light of the aforementioned circumstances, and an object of the present invention is to provide a synthetic resin cap capable of providing excellent tamper evidence performance, achieving both sealing performance and opening performance, and securing leak prevention of contents in the container before breakage of the bridges.

Means for Solving the Problems

In order to achieve the above object, a synthetic resin cap of the present invention includes a top wall, a skirt wall vertically dropping from an outer circumference of the top wall and having an internal thread that comes into screw engagement with an external thread of a container mouth part, and a tamper evidence band connected to a lower part of the skirt wall with breakable bridges interposed therebetween, wherein an inner face of the top wall is provided with an annular inner leg that closely fits with an inner circumferential face of the container mouth part, an annular projection that closely fits with a distal end face of the container mouth part, and an annular outer leg that closely fits with an outer circumferential face of the container mouth part, which are integrally formed, and in the inner leg, a thickness of a transverse section decreases from a proximal end to an intermediate part, a thickness of a transverse section of the intermediate part is substantially constant in a vertical direction, and a thickness of the transverse section decreases from the intermediate part to a distal end, an inner circumferential face and an outer circumferential face of the intermediate part are curved faces that have substantially the same curvature of longitudinal section and are arcuate that are convex inwardly in a radial direction, and an outer circumferential face of a distal end part of the inner leg is provided with a guide face that guides the container mouth part, and the intermediate part is inclined outwardly in the radial direction so that an upper end of the guide face is shifted inwardly in radial direction by 0.1 to 0.6 mm when the inner leg is inserted in the container mouth part (first aspect of the invention).

In the above synthetic resin cap, an inner circumferential face of a distal end part of the outer leg is provided with a guide face for guiding the container mouth part, and the outer leg may be configured so that an upper end of the guide face shifts outwardly in the radial direction by 0.05 to 0.5 mm when the container mouth part is inserted in the outer leg (second aspect of the invention).

Further, in inner face of the top wall, a part continuing on the outer circumferential side with respect to the outer leg may be situated lower than a part continuing on the inner circumferential side (third aspect of the invention).

In the above synthetic resin cap, a latch piece extending inwardly and upwardly from a lower part of the tamper evidence band may be provided in connection with the tamper evidence band, and below the external thread in the container mouth part, a stopper that is overcome by an elastically deformed latch piece at the time of attaching to the container mouth part and latched by an elastically recovered latch piece after attachment may be provided, and in an unopened state after the attachment, a vertical distance from an upper end of the latch piece to a lower face part of the stopper situated directly above the same may be 0.05 to 0.4 mm (fourth aspect of the invention).

In the above synthetic resin cap, a distance from an outer circumferential face of the external thread to an inner circumferential face of the skirt wall may be 0.01 to 0.1 mm in a state where the internal thread of the skirt wall is in screw engagement with the external thread of the container mouth part (fifth aspect of the invention).

Effects of the Invention

In the inventions according to the first through fifth aspects discussed above, it is possible to obtain a synthetic resin cap capable of providing an excellent tamper evidence performance, as well as realizing both sealing performance and opening performance, and capable of securely preventing contents in a container from leaking before breakage of bridges.

That is, in a conventional cap, at the time of opening of the cap, not only a top wall and a skirt wall, but also a part that comes into contact with a container mouth part in an inner leg (hermetically sealing part) turns similarly, and the container mouth part can elastically deform from a circular shape to various shapes including an elliptic shape before completion of the opening operation. When such deformation occurs, a gap is formed between the inner leg and the container mouth part, which becomes a cause of leakage. However, in the cap according to the first aspect of the invention, since the inner leg that is structurally easy to bend easily follows the deformation of the container mouth part, a gap is hardly formed between the inner leg and the container mouth part, and leakage hardly occurs before the inner leg completely leaves the container mouth part.

In the conventional cap, when the bridges are partly broken or elongated at the time of first opening of the cap, the remaining bridges function to anchor the skirt wall to the band, so that an unstable state arises where the cap is likely to incline. Contrarily, in the cap according to the first aspect of the invention, since the inner leg is curved as described above, the inner leg abuts an entire circumference of the inner face of the container mouth part at a substantially constant force. As a result, the cap is hardly inclined, and screwed off while maintaining a generally horizontal state (a state that the top wall and the band are generally parallel).

Further, in the first aspect of the invention, since the inner leg is designed to easily bend structurally by curving the inner leg into the shape as described above, the inner leg reliably deforms to avoid the container mouth part while guiding the container mouth part by the guide face when the cap is attached to the container mouth part by screwing. As a result, the closing performance is exerted satisfactorily. Further, since fitting of the sealing part of the inner leg with respect to the container mouth part can be strengthened by largely inclining the intermediate part of the inner leg outwardly in the radial direction (to make a cramming force of the container mouth part by the inner leg and the outer leg large), a sufficient sealing performance is also achieved.

In the second aspect of the invention, it is possible to further strengthen the fitting of the outer leg with respect to the container mouth part (to make the cramming force of the container mouth part by the inner leg and the outer leg large), and hence it is possible to improve the sealing performance.

In the third aspect of the invention, since the outer leg is made difficult to deform outwardly in the radial direction by providing a level difference as described above in the inner face of the top wall, it is possible to improve the sealing performance.

In the fourth aspect of the invention, since a distance from the stopper to the latch piece is small (0.05 to 0.4 mm), immediately after starting the operation of screwing off the cap from the container mouth part for opening (first opening), the latch piece comes into abutment with the stopper. Accordingly, a tamper evidence band breaks rapidly and a turning amount of the cap from breakage of the bridges to occurrence of leakage can be increased, so that the tamper evidence performance can be improved.

In the fifth aspect of the invention, also by making the clearance between the external thread of the container mouth part and the internal thread of the skirt wall small (0.01 to 0.1 mm), the possibility that the cap inclines is very low. Therefore, even if the cap is inclined, an angle of inclination will not increase, and it is possible to securely control deflection (particularly horizontal deflection) and inclination of the cap before breakage of the tamper evidence band at the time of opening of the cap.

DESCRIPTION OF REFERENCE NUMERALS

Figure 1:
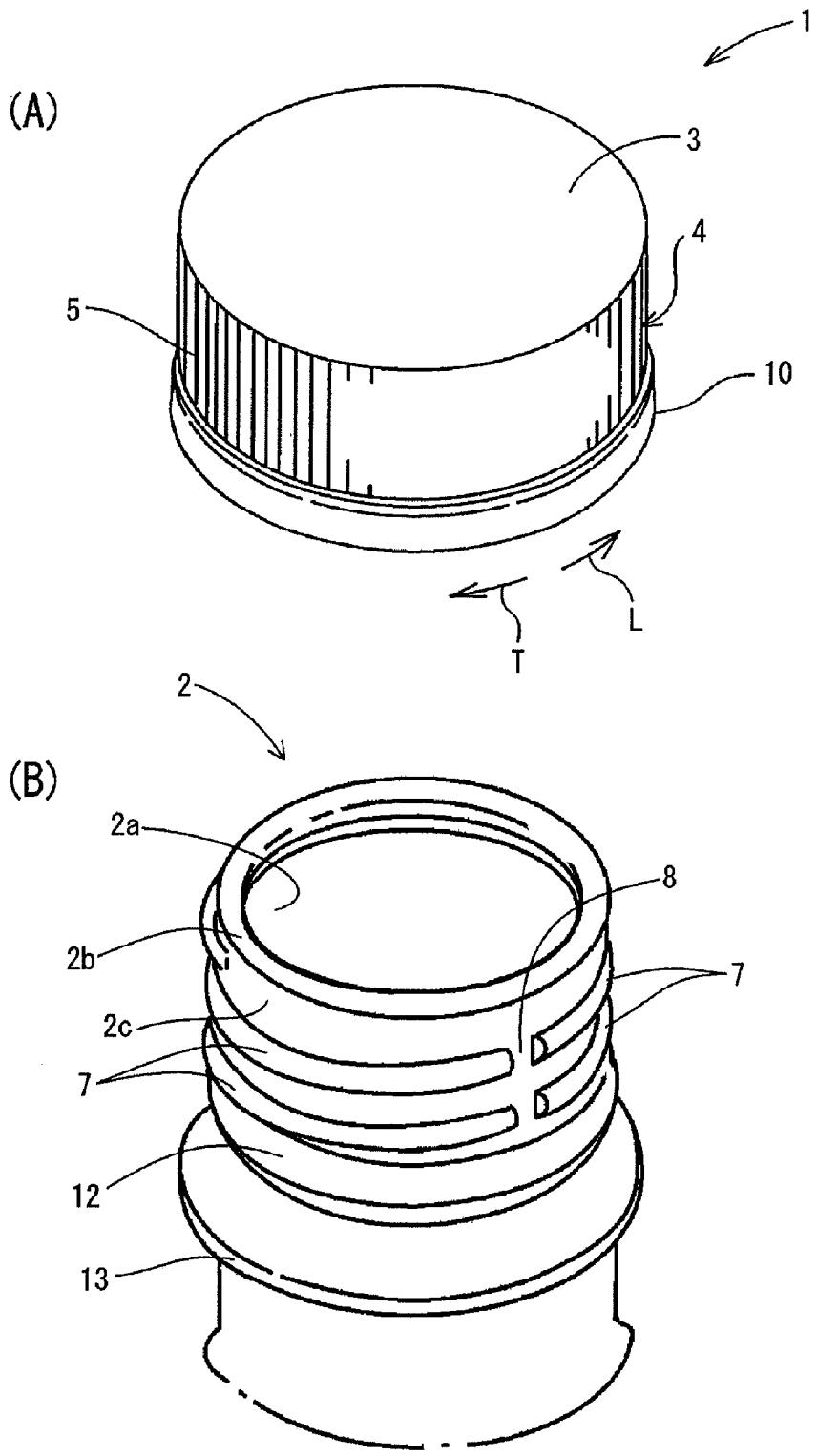
FIGS. 1(A) and 1(B) are perspective views schematically showing configurations of a cap according to one embodiment of the present invention, and a principal part of a container to which the cap is to be attached.

1 Cap
2 Container mouth part
3 Top wall
4 Skirt wall
6 Internal thread
7 External thread
9 Bridge
10 Tamper evidence band
11 Latch piece
14 Inner leg
15 Annular projection
16 Outer leg
17 Proximal end part
18 Intermediate part
19 Distal end part
20 Inner circumferential face
21 Outer circumferential face
22 Guide face

DETAILED DESCRIPTION OF THE INVENTION

Figure 3:
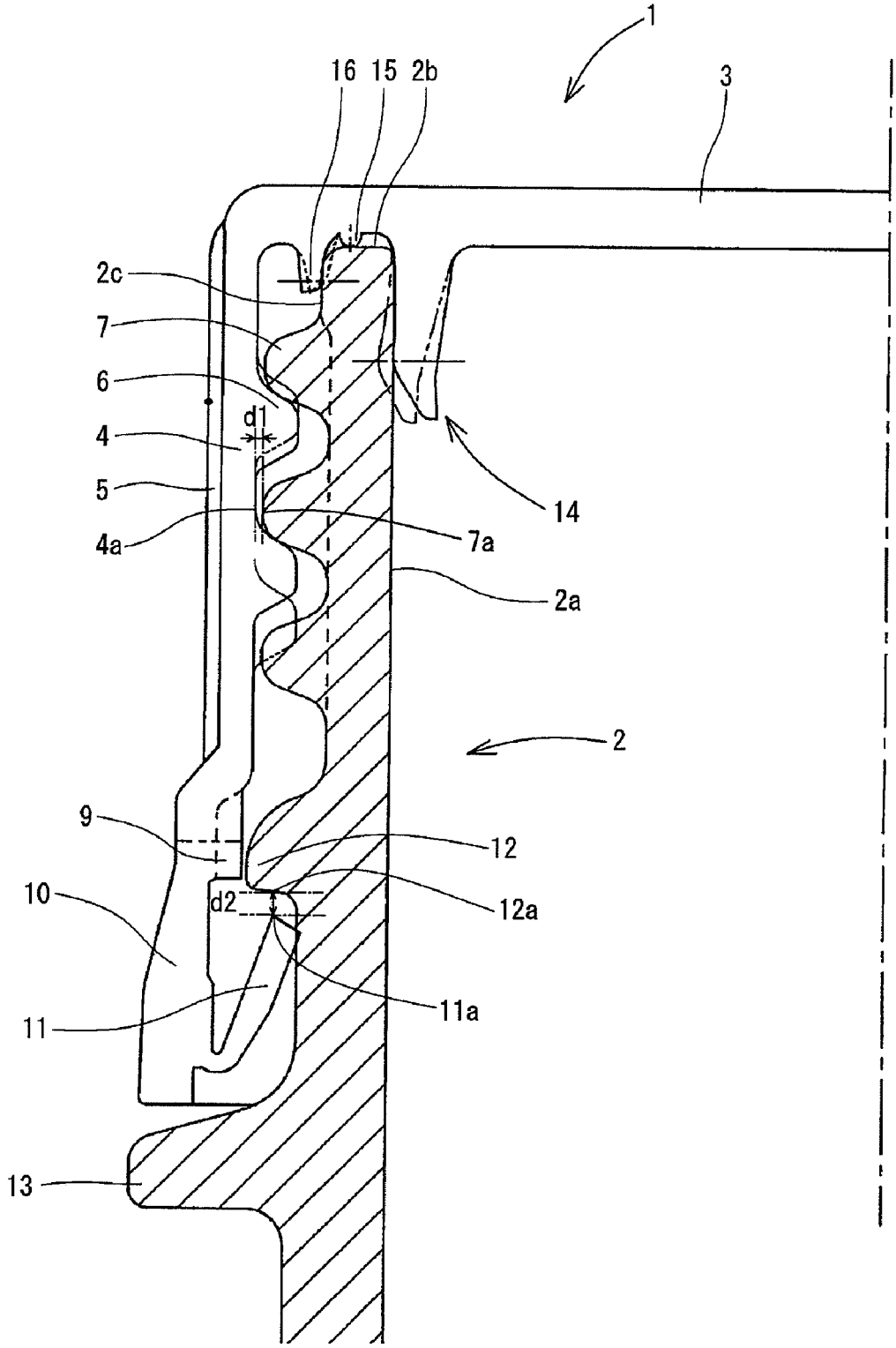
FIG. 3 is a longitudinal section view schematically showing a configuration of a left half of the cap attached to the container.
Figure 4:
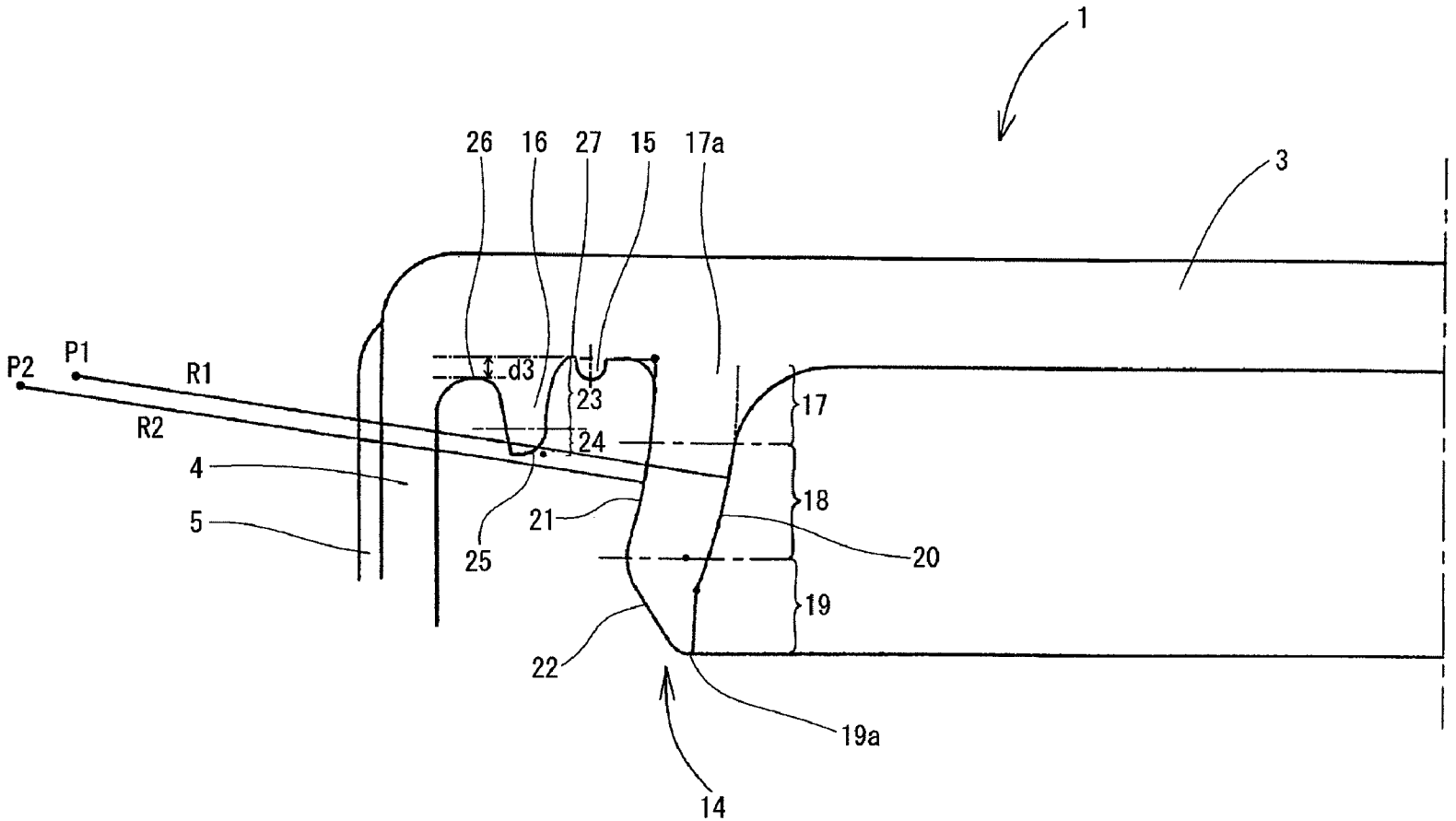
FIG. 4 is a partially enlarged longitudinal section view schematically showing the configuration of the principal part of the cap.

In the following, embodiments of the present invention will be described with reference to the drawings. Here, FIGS. 1(A) and 1(B) are perspective views schematically showing configurations of a synthetic resin cap (hereinafter, simply referred to as "cap") 1 according to one embodiment of the present invention, and a principal part of a container to which the cap is to be attached, FIG. 2 is a partially perspective lateral view schematically showing the configuration of the cap 1, FIG. 3 is a longitudinal section view schematically showing a configuration of a left half of the cap 1 attached to the container, and FIG. 4 is a partially enlarged longitudinal section view schematically showing the configuration of the principal part of the cap 1.

The cap 1 according to the present embodiment is adapted to be attached to a mouth part 2 of a container (for example, PET bottle) that is produced separately from the cap 1 (see FIG. 1(B)), and is molded by injection molding or compression molding.

As a material of the cap 1, a base resin made of, for example, high density polyethylene (HDPE) or polypropylene (PP) is used as a synthetic resin having excellent flexibility and small abrasion resistance.

Figure 2:
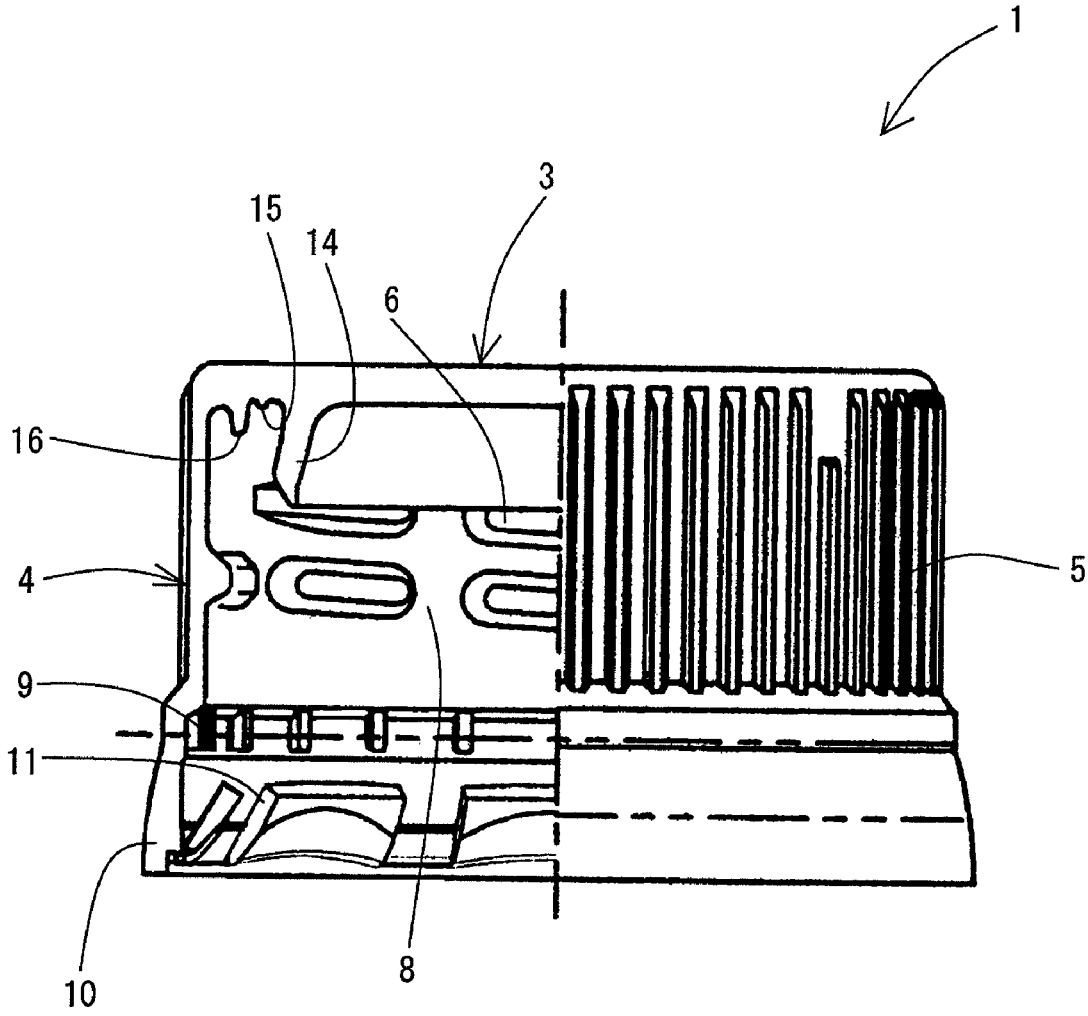
FIG. 2 is a partially perspective lateral view schematically showing the configuration of the cap.

As shown in FIG. 1(A) and FIG. 2, the cap 1 has a top wall 3 which is circular in plan view, and a skirt wall 4 pending from outer circumference of the top wall 3. Here, the outer circumferential face of the skirt wall 4 is provided with a knurled groove 5 and the inner circumferential face is provided with an internal thread 6 (see FIG. 2), and the internal thread 6 is screwed onto an external thread 7 of the container mouth part 2. In respective appropriate positions of the internal thread 6 and the external thread 7 (positions not disturbing attachment and detachment by screwing of both 6 and 7), a longitudinal groove 8 is provided.

In the present embodiment, as shown in FIG. 3, a distance (clearance) d1 between an outer circumferential face 7*a* of the external thread 7 and an inner circumferential face 4*a* of the skirt wall 4 is made to be small in a state where the internal thread 6 of the skirt wall 4 is screwed onto the external thread 7 of the container mouth part 2. The distance d1 is preferably 0.01 to 0.1 mm, and particularly preferably 0.03 to 0.07 mm.

Below the skirt wall 4, as shown in FIG. 1(A) and FIG. 2, a tamper evidence band (hereinafter simply referred to as "band") 10 is connected via a plurality of breakable bridges 9 (see FIG. 2) arranged at a predetermined interval in a circumferential direction, and inside the band 10, a plurality of latch pieces 11 extending inwardly and upwardly from a lower part of the band 10 are provided as shown in FIG. 2.

On the other hand, as shown in FIG. 1(B), the container mouth part 2 is provided with a stopper 12 that is overcome by the band 10 at the time of attaching the cap 1 to the container mouth part 2 and prevents the band 10 from falling out by latching of the band 10 by means of the latch pieces 11, and a flange 13 situated below the stopper 12, for holding the band 10 having overcome the stopper 12 together with the stopper 12.

On the other hand, as shown in FIGS. 2 and 4, an inner face (lower face) of the top wall 3 is provided with an annular inner leg 14 capable of closely fitting with an inner circumferential face 2*a* of the container mouth part 2 (see FIG. 1(B)), an annular projection 15 capable of closely fitting with a distal end face 2*b* of the container mouth part 2 (see FIG. 1(B)), and an annular outer leg 16 capable of closely fitting with an outer circumferential face 2*c* of the container mouth part 2 (see FIG. 1(B)) that are integrally formed.

In the present embodiment, for attaching the cap 1 to the container mouth part 2, a turning force in a direction of an arrow T in FIG. 1(A) is applied on the cap 1 while the internal thread 6 of the cap 1 (see FIG. 2) is brought into screw engagement with the external thread 7 of the container mouth part 2 (see FIG. 1(B)). At this time, the cap 1 screws downward in FIG. 1(A), and then each latch piece 11 of the band 10 (see FIG. 2) comes into abutment with the stopper 12 below the external thread 7 of the container mouth part 2 (see FIG. 1(B)), and is guided by the stopper 12 so as to be elastically deformed in a diameter expanding direction to overcome the stopper 12, and then the latch pieces 11 elastically recovers to the initial state. In this manner, attachment of the cap 1 is completed.

In this attached (unopened) state, as shown in FIG. 3, the inner leg 14 of the cap 1 closely fits with the inner circumferential face 2*a* of the container mouth part 2, and the annular projection 15 of the cap 1 closely fits with the distal end face 2*b* of the container mouth part 2, and the outer leg 16 of the cap 1 closely fits with the outer circumferential face 2*c* of the container mouth part 2. In FIG. 3, the inner leg 14 and the outer leg 16 in the cap 1 that is not attached to the container mouth part 2, are respectively represented by a two-dot chain line and a broken line, and the inner leg 14 and the outer leg 16 in the cap 1 that is attached to the container mouth part 2 are respectively represented by continuous lines.

In this attached (unopened) state, as shown in FIG. 3, a vertical distance d2 from an upper end 11*a* of each latch piece 11 to a lower face part 12*a* of the stopper 12 situated directly above the same is configured to be small. This configuration can be readily obtained, for example, by adjusting a vertical length of the annular projection 15 of the cap 1 abutting the distal end face 2*b* of the container mouth part 2. Here, the distance d2 is preferably 0.05 to 0.4 mm, and particularly preferably 0.1 to 0.3 mm.

The container can be opened by applying a turning force in a direction of an arrow L in FIG. 1(A) on the cap 1 that is attached to the container mouth part 2, and at this time, the band 10 having the latch pieces 11 latching to the stopper 12 of the container mouth part 2 remain on the container mouth part 2, and only the part excluding the band 10 in the cap 1 is screwed off from the container mouth part 2 by the turning force in the direction of the arrow L. Accordingly, all of the bridges 9 connecting the band 10 and the skirt wall 4 break at the first opening.

Here, as shown in FIG. 4, the inner leg 14 has a proximal end part 17, an intermediate part 18 and a distal end part 19 in this order from top to bottom, and configured so that the thickness of transverse section decreases from a proximal end 17*a* to the intermediate part 18, the thickness of transverse section in the intermediate part 18 is substantially constant in the vertical direction, and the thickness of transverse section decreases from the intermediate part 18 to a distal end 19*a*.

As shown in FIG. 4, an inner circumferential face 20 and an outer circumferential face 21 of the intermediate part 18 are formed to have curved surface wherein longitudinal sections have substantially the same curvature and are arcuate that are convex inwardly in a radial direction (right side in FIG. 4) when the cap 1 is not attached to the container mouth part 2. That is, as shown in FIG. 4, the longitudinal sections of the inner circumferential face 20 and the outer circumferential face 21 are arcs having substantially equal diameters R1, R2 centered at certain points P1, P2, and both the points P1, P2 are situated laterally (outward) of the skirt wall 4 of the cap 1.

Further, the outer circumferential face of the distal end part 19 of the inner leg 14 is provided with a taper face which is to be a guide face 22 for guiding the container mouth part 2 in attaching the cap 1 to the container mouth part 2, as shown in FIG. 4, and the intermediate part 18 is inclined outwardly in the radial direction (left direction in FIG. 4) so that an upper end of the guide face 22 (interface between the outer circumferential face 21 and the guide face 22) shifts inwardly in the radial direction by 0.1 to 0.6 mm (more preferably, 0.2 to 0.5 mm) when the inner leg 14 is inserted into the container mouth part 2.

In the present embodiment, an outer diameter of the inner leg 14 in a natural state (the state shown in FIG. 4) is equal to or more than 22 mm in the region where it maximizes (upper end of the guide face 22), and a diameter (inner diameter) of the inner circumferential face of the container mouth part 2 is 21.74 mm.

When the container mouth part 2 has a general PET bottle mouth shape, it is desired that a seal length is 2.2 to 2.8 mm, the diameters R1, R2 of the intermediate part 18 of the inner leg are 6 to 15 mm, and a fitting margin with the container is 0.2 to 0.8 mm.

On the other hand, as shown in FIG. 4, the outer leg 16 has a proximal end part 23, and a distal end part 24 in this order from top to bottom, an inner circumferential face of the distal end part 24 is provided with a guide face 25 for guiding the container mouth part 2, and the outer leg 16 is so configured that an upper end of the guide face 25 shifts outwardly in the radial direction by 0.05 to 0.5 mm (more preferably, 0.1 to 0.3 mm) when the container mouth part 2 is inserted in the outer leg 16. This configuration is readily obtained, for example, by making the wall thickness in a horizontal direction of the outer leg 16 larger on the side of the inner circumference.

As shown in FIG. 4, in the inner face (lower face) of the top wall 3, a part 26 continuing on the outer circumferential side with respect to the outer leg 16 is in a position lower by a distance d3 than a part 27 continuing on the inner circumferential side, and the distance d3 is, for example, 0.1 to 1.0 mm (more preferably 0.1 to 0.5 mm). With this configuration, the outer leg 16 is difficult to be elastically deformed outwardly in the radial direction.

The cap 1 is excellent in water drainage, and when the cap 1 after molding is sterilized and washed with a washing solution, and rinsed with sterile water, the washing solution and the like will not remain in the cap 1, so that it is suitably used for a container whose contents are charged by aseptic charging. However, it goes without saying that it may be used for a container that will not be charged by aseptic charge.

In the cap 1 configured as described above, by making the inner leg 14, which comes into contact with the inner side of the container mouth part 2 when the cap 1 is opened, be curved as described above, the inner leg 14 is structurally easier to bend. As a result, performance of preventing leakage of contents is improved. In other words, in a conventional cap, at the time of opening of the cap 1, not only the top wall 3 and the skirt wall 4, but also the part that comes into contact with the container mouth part 2 in the inner leg 14 (hermetically sealing part) turns similarly, and the container mouth part 2 can elastically deform from a circular shape to various shapes including an elliptic shape before completion of the opening operation. When such deformation occurs, a gap is formed between the inner leg and the container mouth part, which becomes a cause of leakage. However, according to the present cap 1, since the inner leg 14 that is structurally easy to bend easily follows the deformation of the container mouth part 2, a gap is hardly formed between the inner leg 14 and the container mouth part 2. Thus, leakage hardly occurs before the inner leg 14 completely leaves the container mouth part 2.

As described above, all of the bridges 9 are broken at the time of first opening of the cap 1. When the bridges 9 are partly broken or elongated before then, the remaining bridges 9 function to anchor the skirt wall 4 to the band 10, so that an unstable state arises where the cap 1 is likely to incline. However, in the present cap 1, since the inner leg 14 abuts the entire circumference of the inner face of the container mouth part 2 at a substantially constant force by making the inner leg 14 be curved as described above, the cap 1 is hardly inclined, and screwed off while maintaining a generally horizontal state (a state that the top wall 3 and the band 10 are generally parallel).

Further, in the present cap 1, since the inner leg 14 is designed to easily bend structurally by curving into the shape as described above, the inner leg 14 reliably deforms to avoid the container mouth part 2 while guiding the container mouth part 2 by the guide face 22 when the cap 1 is attached to the container mouth part 2 by screwing, and the closing performance is exerted satisfactorily. Further, since fitting of the sealing part of the inner leg 14 with respect to the container mouth part 2 can be strengthened by largely inclining the intermediate part 18 of the inner leg 14 outwardly in the radial direction (to make a cramming force of the container mouth part 2 by the inner leg 14 and the outer leg 16 large), sufficient sealing performance is also achieved.

Additionally, in the present cap 1, the upper end of the guide face 25 of the outer leg 16 shifts outwardly in the radial direction when the container mouth part 2 is inserted in the outer leg 16, and as a reaction thereof, a force acts to push the container mouth part 2 toward the inner circumferential side. Therefore, it is possible to further strengthen the fitting of the outer leg 16 with respect to the container mouth part 2 (to make the cramming force of the container mouth part 2 by the inner leg 14 and the outer leg 16 large), and to improve the sealing performance.

Moreover, in the present cap 1, the outer leg 16 is made difficult to elastically deform outwardly in the radial direction by providing a level difference as described above in the inner face of the top wall 3. This also improves the sealing performance dramatically.

In the present cap 1, since the distance from the stopper 12 to the latch piece 11 is small, immediately after starting the operation of screwing off the cap 1 from the container mouth part 2 for opening, the latch piece 11 comes into abutment with the stopper 12. Accordingly, the band 10 breaks rapidly and a turning amount of the cap 1 from breakage of the bridges 9 to occurrence of leakage can be increased, so that the tamper evidence performance can be improved.

In the present cap 1, also by making a clearance between the external thread 7 of the container mouth part 2 and the internal thread 6 of the skirt wall 4 small, the possibility that the cap 1 inclines is very low, and even if the cap 1 is inclined, an angle of inclination will not increase, so that it is possible to securely control deflection (particularly horizontal deflection) and inclination of the cap 1 before breakage of the band 10 at the time of opening of the cap 1.

Excellence in tamper evidence performance of the present cap 1 was confirmed by the tests conducted according to the following procedures (1) to (4).

(1) A 500-mL PET bottle (hereinafter, simply referred to as "bottle") is charged with water at normal temperature, and a cap is attached (capping) to the bottle to prepare a sample. (2) The sample is stored at 20° C. to 24° C. for 24 hours or longer (samples are placed under the same temperature in the following steps). (3) The bottle is opened by turning the cap at low speed. (4) A turning amount of the cap from starting of the bottle opening to breakage of bridges (bridge angle), a turning amount of the cap from starting of the bottle opening to leakage (opening angle), and a number of bridges broken at the time of leakage are examined.

In the above test, whether the tamper evidence performance is good or not can be evaluated based on the opening angle, the number of broken bridges, and the bridge angle examined in the above procedure (4). That is, in principle, the tamper evidence performance is guaranteed when the leakage at the time of bottle opening occurs simultaneously or subsequent to breakage of bridges, and in particular, if all of the bridges are broken before occurrence of leakage (if breakage of all of the bridges is observed at the time of leakage in the above procedure (4)), it can be evaluated that the tamper evidence performance is excellent.

The above test was conducted several times for a bottle equipped with a cap commonly appearing on the market, and it was often the case that leakage and breakage of bridge 9 occur at the same time, or leakage occurs before all of the bridges 9 are broken. However, when the above test was conducted several times for a bottle equipped with the present cap 1, leakage occurred every time after breakage of all of the bridges 9, and this result proved that the present cap 1 has sufficient tamper evidence performance.

INDUSTRIAL APPLICABILITY

The synthetic resin cap according to the present invention may be applied to a pilfer proof cap because an inner leg that is easy to bend structurally can easily follow deformation of a container mouth part, so that a gap is hardly formed between the inner leg and the container mouth part, and thus leakage hardly occurs before the inner leg fully leaves the container mouth part.

What is claimed is:

1. A synthetic resin cap comprising:

a top wall;

a skirt wall vertically dropping from an outer circumference of the top wall and having an internal thread for coming into screw engagement with an external thread of a container mouth part; and a tamper evidence band connected to a lower part of the skirt wall with breakable bridges interposed therebetween, wherein an inner face of the top wall is provided with an annular inner leg arranged to closely fit with an inner circumferential face of the container mouth part, an annular projection arranged to closely fit with a distal end face of the container mouth part, and an annular outer leg arranged to closely fit with an outer circumferential face of the container mouth part, the annular inner leg, the annular projection and the annular outer leg being integrally formed with the top wall, wherein in the annular inner leg, a thickness of a transverse section decreases from a proximal end of the annular inner leg to an intermediate part thereof, a thickness of a transverse section of the intermediate part is substantially constant in a vertical direction, and a thickness of a transverse section decreases from the intermediate part to a distal end of the annular inner leg, wherein an inner circumferential face and an outer circumferential face of the intermediate part are curved faces that have substantially the same curvature of longitudinal section and are arcuate so as to be convex inwardly in a radial direction, wherein an outer circumferential face of a distal end part of the annular inner leg is provided with a guide face arranged to guide the container mouth part, and the intermediate part is inclined outwardly in the radial direction so that an upper end of the guide face is shifted inwardly in the radial direction by 0.1 to 0.6 mm when the annular inner leg is inserted in the container mouth part, wherein an uppermost end of an outer circumferential face of the annular outer leg is positioned lower than an uppermost end of an inner circumferential face of the annular outer leg, and wherein the tamper evidence band includes a latch piece extending inwardly and upwardly from a lower part of the tamper evidence band, the latch piece being elastically deformable so as to overcome a stopper provided below the external thread in the container mouth part at the time of attaching to the container mouth part and so as to latch onto the stopper by elastic recovery of the latch piece, such that in an unopened state after the attachment, a vertical distance from an upper end of the latch piece to a lower face part of the stopper situated directly above the upper end of the latch piece is 0.05 to 0.4 mm.

2. The synthetic resin cap according to claim 1, wherein an inner circumferential face of a distal end part of the annular outer leg is provided with a guide face for guiding the container mouth part, and the annular outer leg is configured so that an upper end of the guide face shifts outwardly in the radial direction by 0.05 to 0.5 mm when the container mouth part is inserted inside of the radially outer leg.

3. The synthetic resin cap according to claim 1, wherein a portion of the inner face of the top wall extending from the uppermost end of the outer circumferential face of the annular outer leg is situated lower than a portion of the inner face of the top wall extending from the uppermost end of the inner circumferential face of the annular outer leg.

4. The synthetic resin cap according to claim 2, wherein a portion of the inner face of the top wall extending from the uppermost end of the outer circumferential face of the annular outer leg is situated lower than a portion of the inner face of the top wall extending from the uppermost end of the inner circumferential face of the annular outer leg.

5. The synthetic resin cap according to claim 1, wherein a distance from an outer circumferential face of the external thread to an inner circumferential face of the skirt wall is 0.01 to 0.1 mm in a state where the internal thread of the skirt wall is in screw engagement with the external thread of the container mouth part.

6. The synthetic resin cap according to claim 2, wherein a distance from an outer circumferential face of the external thread to an inner circumferential face of the skirt wall is 0.01 to 0.1 mm in a state where the internal thread of the skirt wall is in screw engagement with the external thread of the container mouth part.

7. The synthetic resin cap according to claim 3, wherein a distance from an outer circumferential face of the external thread to an inner circumferential face of the skirt wall is 0.01 to 0.1 mm in a state where the internal thread of the skirt wall is in screw engagement with the external thread of the container mouth part.

8. The synthetic resin cap according to claim 4, wherein a distance from an outer circumferential face of the external thread to an inner circumferential face of the skirt wall is 0.01 to 0.1 mm in a state where the internal thread of the skirt wall is in screw engagement with the external thread of the container mouth part.

* * * * *